United States Patent [19]

Long

[11] Patent Number: 4,541,132

[45] Date of Patent: Sep. 17, 1985

[54] SHOWER PAN

[76] Inventor: Jack C. Long, 13030 NE. 102nd Pl., Kirkland, Wash. 98033

[21] Appl. No.: 577,734

[22] Filed: Feb. 9, 1984

Related U.S. Application Data

[63] Continuation of Ser. No. 374,323, May 3, 1983, abandoned.

[51] Int. Cl.[4] ..... A47K 3/22

[52] U.S. Cl. ..... 4/614; 29/157 R; 29/445; 29/460; 52/35; 144/360; 144/371

[58] Field of Search ..... 4/612, 614, 593, 596; 29/460, 445, 157 R; 229/DIG. 2; 52/34, 35; 144/359, 363, 371, 360

[56] References Cited

U.S. PATENT DOCUMENTS

| | | | |
|---|---|---|---|
| 1,723,410 | 8/1929 | Dickert | 4/596 |
| 1,900,658 | 3/1933 | Niedecken | 4/596 |
| 2,282,329 | 5/1942 | Johnson | 4/612 |
| 2,330,294 | 9/1943 | Leavitt et al. | 229/DIG. 2 |
| 2,389,724 | 11/1945 | Falco | 4/612 |
| 2,836,830 | 6/1958 | Norman | 4/613 |
| 3,501,879 | 3/1970 | Mitchell et al. | 4/612 |
| 3,722,151 | 3/1973 | Gardner | 52/34 |
| 3,757,358 | 9/1973 | Chisholm et al. | 52/34 |
| 4,216,042 | 7/1980 | Weaver | 4/614 |

FOREIGN PATENT DOCUMENTS

| | | | |
|---|---|---|---|
| 667551 | 7/1963 | Canada | 4/612 |

*Primary Examiner*—Charlie T. Moon
*Attorney, Agent, or Firm*—Roy E. Mattern, Jr.

[57] ABSTRACT

A shower pan which forms a base of a shower stall has a one piece drain surface and is capable of being built in various sloping configurations. The shower pan is constructed of a top drain panel supported by graduated shims and perimeter strips which are in turn mounted on a planar foundation. Perimeter strips and graduated shims are secured to the foundation, concentrically spaced apart surrounding a variably located drain opening. The top drain panel is cut to the same contour and size as the foundation and has a rear member, side members, and threshold members to provide lateral water barriers. Kerfed break lines in the top drain panel permit the panel to bend to form a basin like drain surface. The kerfed relief lines are in the form of at least two concentric, straight lined, polygonal cuts which are substantially identical in shape and have their corresponding vertices connected by radial relief lines. The top drain panel is positioned and pressed down onto the shims at perimeter strips forming a drain basin with sloping panel sections defined by the kerfed break lines. A waterproof material such as hot mop tar is applied to the interior surfaces of the shower pan. An adhesive is then applied to all exposed surfaces and a finish covering such as ceramic tile or cultured marble is applied to the shower pan.

13 Claims, 7 Drawing Figures

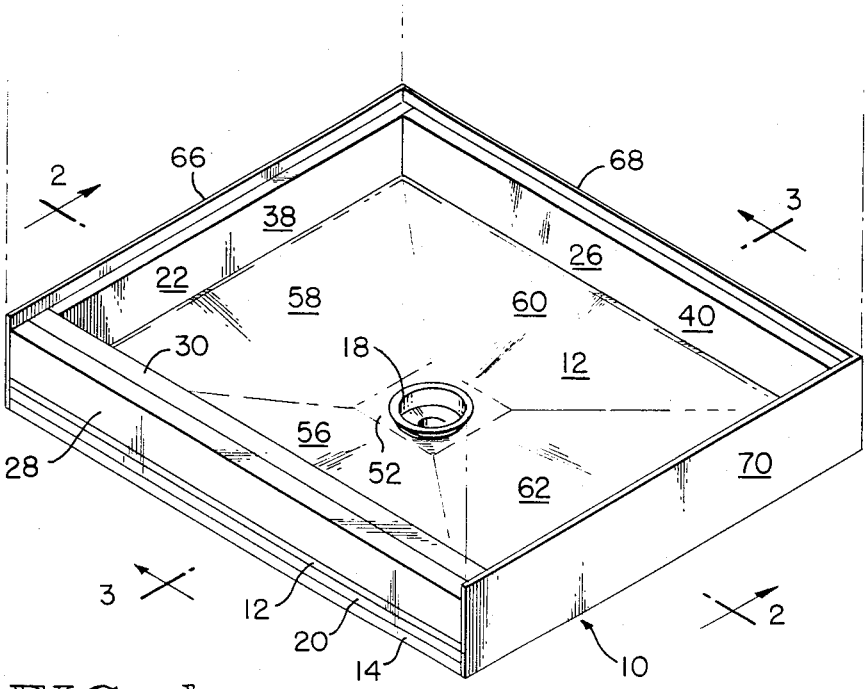
FIG. 1
FIG. 2
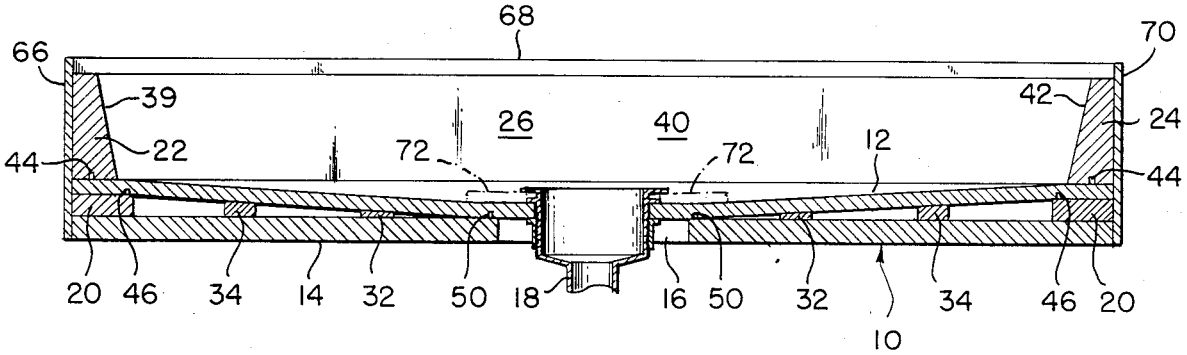
FIG. 3
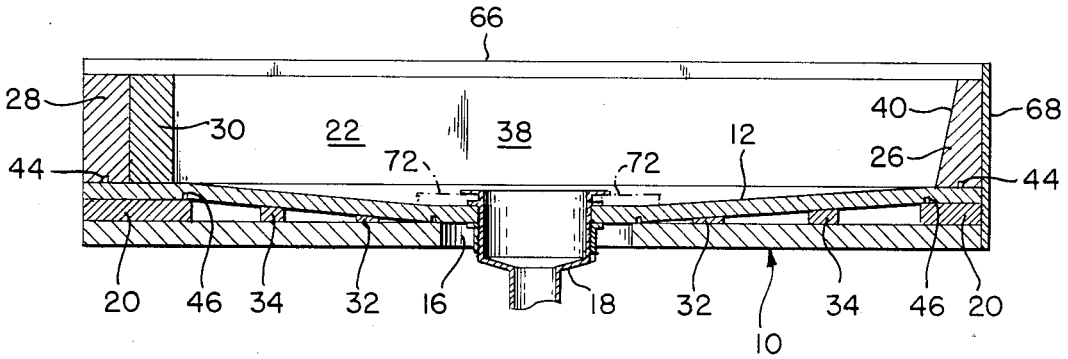

SHOWER PAN

This is a continuation, of application Ser. No. 374,323, filed May 3, 1983, now abandoned.

SUMMARY OF THE INVENTION

A shower pan which forms a base of a shower stall has a one piece drain surface which is capable of being built in various sloping configurations. The shower pan is preferably constructed of wood as a prefabricated unit and includes a top drain panel supported by graduated shims and perimeter strips which are in turn mounted on a planar foundation. Sets of graduated shims are secured to the foundation in space relation to each other, surrounding an oversize drain opening. Perimeter strips are positioned along the outside edges of the foundation. The preferred embodiment of the shower pan illustrates a top drain panel which is supported by two evenly spaces sets of shims, concentrically surrounding a centrally located drain opening. The top drain panel is cut to the same contour as the foundation and is preferably made of plywood. A drain opening in the panel is cut concentrically with the opening in the foundation. A rear member, side members and threshold members are secured to the top drain panel along its outside edges to provide lateral water barriers. The side members and rear member preferably have inward sloping faces while the threshold members are vertical, positioned perpendicularly to the top drain panel. The top drain panel is scored with kurfed relief lines to permit the panel to bend to form a basin like drain surface with the section of the drain panel which surrounds the drain at the lowest elevation. The kerfed relief lines, which define sloping panel sections, are in the form of at least two concentric, straight lined, polygonal cuts which are substantially identical in shape and have their corresponding vertices connected by radial relief lines. The top drain panel is positioned on the perimeter strips and shims and pressed down to form the sloping drain basin. Outer wall panels are then secured to the sides and back of the shower pan. Waterproof resin or filler may be applied to the exposed break lines, though the preferred embodiment includes break lines which are cut on the bottom surface of the top panel. The entire interior surface of the shower pan is covered with a waterproof material such as hot mop tar. An adhesive is then applied to all exposed surfaces and a finished covering such as ceramic tile or cultured marble is applied.

BRIEF DESCRIPTION OF THE DRAWINGS

FIG. 1 is a perspective view of the preferred embodiment of the shower pan.

FIG. 2 is a sectional view taken along line 2—2 of FIG. 1.

FIG. 3 is a sectional view taken along line 3—3 of FIG. 1.

DETAILED DESCRIPTION OF THE INVENTION

Figure 4:
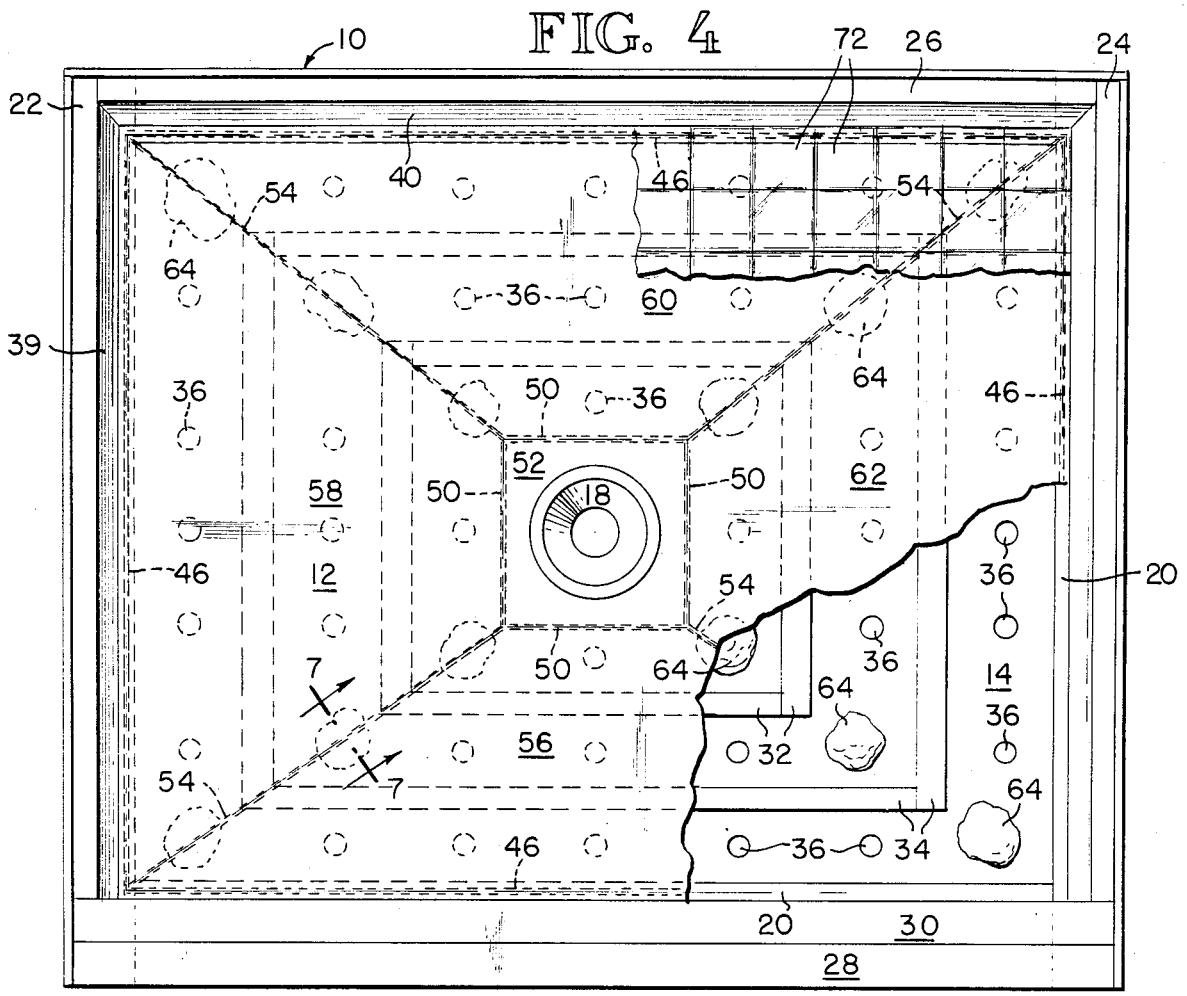
FIG. 4 is a top plan view illustrating the shower pan with a portion of the interior surface with a finish covering and with a portion of the drain panel broken away.
Figure 5:
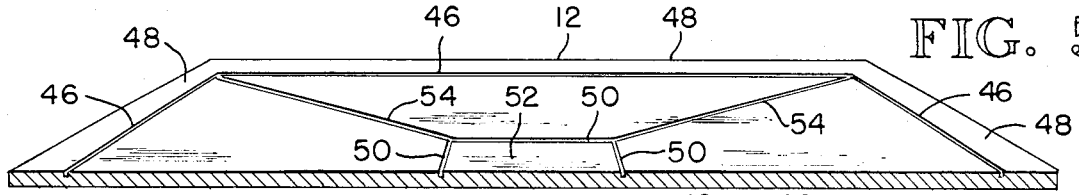
FIG. 5 is a perspective sectional view of the drain panel inverted and in the flat condition, prior to bending, illustrating the location of the kerfed relief lines.
Figure 6:
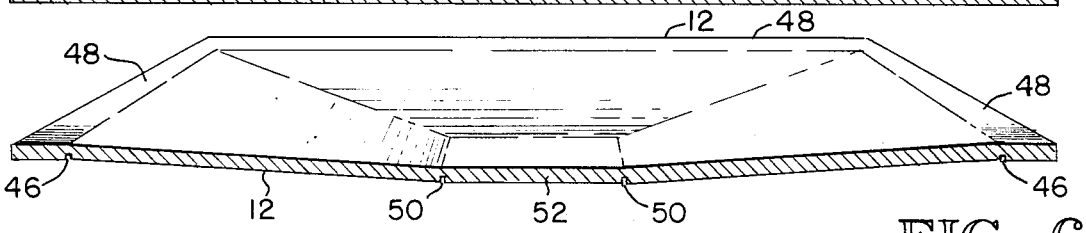
FIG. 6 is a perspective sectional view of the top of the drain panel in the formed condition.
Figure 7:
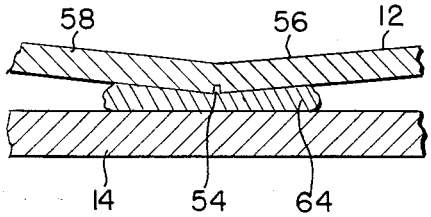
FIG. 7 is an enlarged, partial sectional view taken along the line 7—7 of FIG. 4.

A shower pan 10 which forms a base of a shower stall has a one-piece drain surface which is capable of being built in various sloping configurations. The shower pan is preferably constructed of wood as a prefabricated unit to be adapted to an existing shower installation or installed in a new shower installation. The shower pan is constructed of a top drain panel 12 supported by graduated shims and perimeter strips which are in turn mounted on a planar foundation 14. The preferred embodiment is illustrated in FIGS. 1 through 7.

The shower pan 10 has a planar foundation 14 preferably made of $\frac{3}{4}$ inch plywood, although materials such as other fiberous materials may be used. The foundation is cut to the desired size and shape of the overall shower pan. An oversized hole 16 is cut through the foundation to receive a drain fixture 18.

Perimeter strips 20 are positioned along the outside edges of the foundation and secured to the foundation preferably with plasterboard screws. The width of the perimeter strips are such that they are wider than the side members 22 and 24, back member 26, and the combined width of the threshold members 28 and 30 described below.

One or more sets of graduated shims are positioned on the foundation in spaced relation to each other and the perimeter strips 20 and surround the drain opening 26. The shims are preferably attached with glue and plasterboard screws to the foundation. The shims, combined with the perimeter strips, provide support for the drain panel 12. The preferred embodiment illustrated in the drawings has a centrally located drain 18 and the drain panel 12 is supported, in part, by two sets of shims 32 and 34 spaced evenly between lines 46 and 50 which are described below. The shims 32 and 34 concentrically surround the drain opening 26. The height of the shims 32 and 34 relative to the perimeter strips 20 and to each other may vary according to the desired slope of the drain panel 12, with at least a $\frac{1}{2}''$ slope per foot being preferred.

Vent holes 36 preferably are cut through the foundation as shown in FIG. 4 to prevent condensation from developing between the foundation 14 and the drain panel 12.

The drain panel 12 is cut to the same contour and size as the foundation or, preferably slightly larger than the foundation. It is preferably cut from a sheet of $\frac{1}{2}''$ plywood. Like in the foundation, other materials may also be used. A drain opening is cut through the panel, concentrically positioned with the opening in the foundation, for closely receiving the drain fixture 18.

Side members 22 and 24, rear member 26, and threshold members 28 and 30 provide lateral water barriers. The side members 24 and 26 and rear member 26 preferably have inward sloping faces 38, 40, and 42 cut to a $17\frac{1}{2}$ degree angle as shown in FIGS. 2 and 3. The threshold members are preferably formed by a pair of parallel two by fours. Longitudinal glue receiving grooves 44 are cut into the bottom of the side members, threshold members, and the rear member.

The top drain panel 12 is scored with kerfed relief lines to permit the panel to bend to form a basin-like drain surface with the section of the drain panel which surrounds the drain at the lowest elevation. The relief lines are preferably scored on the bottom surface of the panel, but they alternately can be placed on the top surface. The kerfed relief lines are formed by cutting, preferably half way through, the drain panel from the bottom. The kerfed relief lines are in the form of at least two concentric, straight lined, polygonal cuts which are substantially identical in shape and have their corresponding vertices connected by radial relief lines. A suggested and preferred method for constructing and forming the kerfed drain panel is illustrated by the preferred embodiment. An outer rectangular relief cut 46 is made at a position in from and parallel to the outside edges of the drain panel at a distance intermediate to the width of the perimeter strips below and the corresponding side, back or threshold member above. This cut defines what will become an upper elevated section 48 of the panel along the outside edges. The inner relief cut 50 is an approximately 7×7" square which surrounds the drain opening. The sides of the inner relief cut are parallel to the sides of the outer relief cut and to the outside edges of the panel. The inner relief cut defines what will become a lowered section 52 around the drain at the lowest point on the panel. Radial relief cuts 54 are scored between and connecting the corners of the inner and outer relief cuts in the drain panel, defining what will become the sloping panel sections 56, 58, 60, and 62. Since the outer relief cuts are positioned inside the edges of the perimeter strips 20, the perimeter strips will support the loads on the sloping panel sections near the outer relief cuts.

The side members 22 and 24, rear member 26, and threshold members 28 and 30 are secured to the perimeter of the drain panel, using an adhesive in the grooves 44, such as epoxy or glue, and plasterboard screws.

To form the sloped drain basin from the drain panel an adhesive, such as glue is applied to the top surfaces of the graduated perimeter strips and shims. Additional support for the drain panel may be provided by applying viscous material 64 such as blobs of portland cement to the surface of the foundation beneath the positions of the radial relief cuts 54. The top drain panel 12 is then set onto the perimeter strips, centrally alligned with the outer edges of the foundation and pressed down onto the shims, perimeter strips, and viscous material and so that the lowest section of the panel 52 is in communication with and supported by the top surface of the planar foundation as shown in FIGS. 2 and 3. The outside edges of the foundation 14 and the top panel 12 are now vertically alligned due to the slightly oversized dimensions of the previously flat drain panel.

Where the side members and rear members are made of more rigid materials, such as heavier lumber or multiple members, the drain basin should be formed before the side members, rear member and threshold members are attached. If these members are too rigid such that their centers cannot flex somewhat and they are attached before formation of the basin shape the drain panel tends to fail structurally along the relief lines. The failures tend to occur particularly in the center of the outer relief cut along the outer sides of the sloping panel sections if these lateral water barriers are to rigid. The same type of structural failure will occur if the upper elevated section 48 is too wide or thick and therefore not flexible enough.

While a centrally located drain opening with concentrically positioned shims is illustrated in the drawing, the openings and may be placed anywhere in the panel. Such placement will vary the angle of the panel sections of the drain panel and positioning and sizing of the shims under each panel section. However, the drain opening cannot be placed too close to an edge of the drain panel. Normally there should be at least ten inches or more space between the inner break line 50 and the outer break line 46.

Outer wall panels 66, 68 and 70 are then secured with an adhesive, such as glue, and plasterboard screws to the sides and back of the shower base. They extend from the bottom of the foundation to above the top of the side walls. The outer walls may be made of a fiberous material, such as plywood or hardboard.

Waterproofing is achieved first by filling the exposed break lines 48, 50, and 54 with a waterproof resin or other filler if the relief lines were cut in the top surface of the drain panel 12. If the relief lines were cut in the bottom surface they need not be filled. The entire interior surface of the top drain panel is then covered with a water proofing material such as hot mop tar.

The structure resulting from the above described methods of construction results in a shower pan which has sharply angled corners. Such a structure is most desirable when ceramic tile or cultured marble is applied to the interior surfaces and the threshold of the shower pan. By way of contrast, shower pans which are molded of plastic, Fiberglas resin or similar materials or made of formed metals generally have rounded corners which are unsuitable for use with such lining materials.

An adhesive is then applied to all exposed surfaces and a finish covering such as ceramic tile 72 or cultured marble is applied to the interior surfaces of the shower pan and the threshold. To ensure proper fitting of the sections of tile or marble, the side members, rear wall, or threshold members may be shimed to accommodate the width of tile segments.

I claim:

1. A pre-fabricated shower panel, comprising:

(a) a single piece multiple ply fibrous drain panel having a first substantially flat pre-installed orientation and a second contoured installed orientation;

(b) said panel when in said installed orientation having an elevated section joined to a lower section by interconnected sloping sections contiguous with said elevated and lower sections;

(c) said lower section of polygon shape with straight edges thereof provided by kerfed relief cuts adapted for facilitating displacement of said lower section from said pre-installed to said installed orientation and for providing straight edges for an overlayer;

(d) said lower section having a drain opening therethrough;

(e) said sloping sections include section to section boundaries provided by straight relief cuts extending radially outwardly from the vertices of intersection of the straight edges of the polygon shape defining said lower section and adapted for facilitating displacement of said lower section from said pre-installed to said installed orientation and for providing straight boundary edges for an overlayer;

(f) a foundation adapted for supporting said lower section; and, (g) support members disposed between said foundation and at least said elevated section for supporting said panel.

2. A shower pan, as claimed in claim 1, wherein the upper, elevated section and the lower section are substantially horizontally planar with the sloping sections sloping downward from their outer perimeter to their inner perimeter to drain water toward the drain opening.

3. A shower pan, as claimed in claim 1 wherein the polygon at the inner edge of the upper, elevated section and the polygon at the outer edge of the lower section are identically shaped and their corresponding sides are parallel.

4. A shower pan, as claimed in claim 3, wherein the polygon at the inner edge of the upper elevated section and the polygon at the outer edge of the lower section are rectangles.

5. A shower pan, as claimed in claim 1, wherein the foundation is planar and the lower section is planar and has a lower surface which contacts and is supported by the foundation.

6. A shower pan, as claimed in claim 1 wherein the foundation is planar and the support members comprise perimeter strips which contact the edge of the sloping sections near the inside of their outer edges to support them.

7. A shower pan, as claimed in claim 6, wherein the perimeter strips fully support the outer section on a horizontal upper surface.

8. A shower pan, as claimed in claim 7, wherein the shower pan further includes a surrounding water retaining barrier secured to the top of the outer section of the drain panel.

9. A shower pan, as claimed in claim 8, wherein the shower pan further includes a shim of a height less than the support members supported by the foundation which supports the sloping sections intermediate to their outer and inner ends.

10. A shower pan, as claimed in claim 9, wherein there are a plurality of such shims in the form of concentric polygons and which are graduated in height to support the sloping sections.

11. A shower pan, as claimed in claim 1; wherein the drain pan is supported along the radial relief lines by a hardened form of a hardenable, viscous material.

12. A shower pan, as claimed in claim 8, wherein the intersection of the water retaining barrier and the drain panel form a sharp corner so that the shower pan may be covered with a ceramic tile or the like.

13. A shower pan as defined in claim 1 wherein the graduated shims are spaced apart equally beneath each sloping section wherein as the space between shims beneath a sloping section decreases, the pitch of the slope of that sloping section increases.

* * * * *